US010722416B2

(12) United States Patent
Hou et al.

(10) Patent No.: US 10,722,416 B2
(45) Date of Patent: Jul. 28, 2020

(54) MULTI-POSTURE LOWER LIMB REHABILITATION ROBOT

(71) Applicant: Institute of Automation Chinese Academy of Sciences, Beijing (CN)

(72) Inventors: Zengguang Hou, Beijing (CN); Weiqun Wang, Beijing (CN); Long Peng, Beijing (CN); Xu Liang, Beijing (CN); Liang Peng, Beijing (CN); Long Cheng, Beijing (CN); Xiaoliang Xie, Beijing (CN); Guibin Bian, Beijing (CN); Min Tan, Beijing (CN); Lincong Luo, Beijing (CN)

(73) Assignee: Institute of Automation Chinese Academy of Sciences, Beijing (CN)

( * ) Notice: Subject to any disclaimer, the term of this patent is extended or adjusted under 35 U.S.C. 154(b) by 470 days.

(21) Appl. No.: 15/559,819

(22) PCT Filed: Mar. 20, 2015

(86) PCT No.: PCT/CN2015/074810
§ 371 (c)(1),
(2) Date: Sep. 19, 2017

(87) PCT Pub. No.: WO2016/149891
PCT Pub. Date: Sep. 29, 2016

(65) Prior Publication Data

US 2018/0133088 A1 May 17, 2018

(51) Int. Cl.
*A61H 1/02* (2006.01)
*A61H 1/00* (2006.01)
(Continued)

(52) U.S. Cl.
CPC ..... *A61H 1/0262* (2013.01); *A61H 1/00* (2013.01); *A61H 1/02* (2013.01); *A61H 1/024* (2013.01);
(Continued)

(58) Field of Classification Search
CPC ..... A61H 1/00; A61H 1/001; A61H 1/005; A61H 1/02; A61H 1/0218; A61H 1/0222;
(Continued)

(56) References Cited

U.S. PATENT DOCUMENTS 10,010,472 B2 * 7/2018 Gu ..... A61G 7/10
2005/0101448 A1 5/2005 He et al.
(Continued)

FOREIGN PATENT DOCUMENTS

CN 1875904 A 12/2006
CN 1973806 A 6/2007
(Continued)

OTHER PUBLICATIONS

PCT/CN2015/074810 Search Report.

*Primary Examiner* — Colin W Stuart
(74) *Attorney, Agent, or Firm* — Maier & Maier, PLLC

(57) ABSTRACT

The application presents a multi-posture lower limb rehabilitation robot, which includes a robot base and a training bed. The training bed comprises two sets of leg mechanisms, a seat, a seat width adjustment mechanism, a mechanism for adjusting the gravity center of human body, a back cushion, a weight support system and a mechanism for adjusting the back cushion angle. The robot base comprises a mechanism for adjusting the bed angle. The mechanisms for adjusting the angles of bed and back cushion can be used together to provide paralysis patients with multiple training modes of lying, sitting, and standing postures. Each leg mechanism comprises hip, knee, and ankle joints, which are driven by
(Continued)

electric motors; angle and force sensors are installed on each joint, and can be used to identify patients' motion intention to provide patients with active and assistant training. The mechanism for adjusting the gravity center of human body, the leg mechanisms, and the weight support system can be used together to implement human natural walking gait to improve the training effect.

7 Claims, 3 Drawing Sheets

(51) Int. Cl.

| | |
|---|---|
| ***A61H 3/00*** | (2006.01) |
| *A63B 23/04* | (2006.01) |
| *A61H 3/04* | (2006.01) |
| *A63B 21/00* | (2006.01) |

(52) U.S. Cl.
CPC ..... *A61H 1/0229* (2013.01); *A61H 1/0237* (2013.01); *A61H 1/0244* (2013.01); *A61H 1/0255* (2013.01); *A61H 1/0259* (2013.01); *A61H 3/00* (2013.01); *A61H 3/008* (2013.01); *A61H 3/04* (2013.01); *A61H 2003/007* (2013.01); *A61H 2201/0138* (2013.01); *A61H 2201/0142* (2013.01); *A61H 2201/0149* (2013.01); *A61H 2201/0157* (2013.01); *A61H 2201/0192* (2013.01); *A61H 2203/0406* (2013.01); *A61H 2203/0425* (2013.01); *A61H 2203/0443* (2013.01); *A61H 2203/0456* (2013.01); *A61H 2203/0481* (2013.01); *A61H 2203/0487* (2013.01); *A61H 2205/102* (2013.01); *A61H 2205/106* (2013.01); *A61H 2205/108* (2013.01); *A63B 21/00178* (2013.01); *A63B 23/0405* (2013.01)

(58) Field of Classification Search
CPC .... A61H 1/0229; A61H 1/0237; A61H 1/024; A61H 1/0244; A61H 1/0255; A61H 1/0259; A61H 1/0262; A61H 3/00; A61H 3/008; A61H 3/04; A61H 2003/007; A61H 2003/043; A61H 2201/01; A61H 2201/0119; A61H 2201/0134; A61H 2201/0138; A61H 2201/0142; A61H 2201/0146; A61H 2201/0149; A61H 2203/0425; A61H 2203/0431; A61H 2203/0437; A61H 2203/0443; A61H 2203/0456; A61H 2203/0481; A61H 2203/0487
See application file for complete search history.

(56) References Cited

U.S. PATENT DOCUMENTS

| | | | | |
|---|---|---|---|---|
| 2014/0087922 | A1 | 3/2014 | Bayerlein et al. | |
| 2015/0320630 | A1* | 11/2015 | Bucher ..... | A61H 1/0262 601/26 |

FOREIGN PATENT DOCUMENTS

| | | | |
|---|---|---|---|
| CN | 101536955 | A | 9/2009 |
| CN | 102512307 | A | 6/2012 |
| CN | 102743270 | A | 10/2012 |
| CN | 102836048 | A | 12/2012 |

* cited by examiner

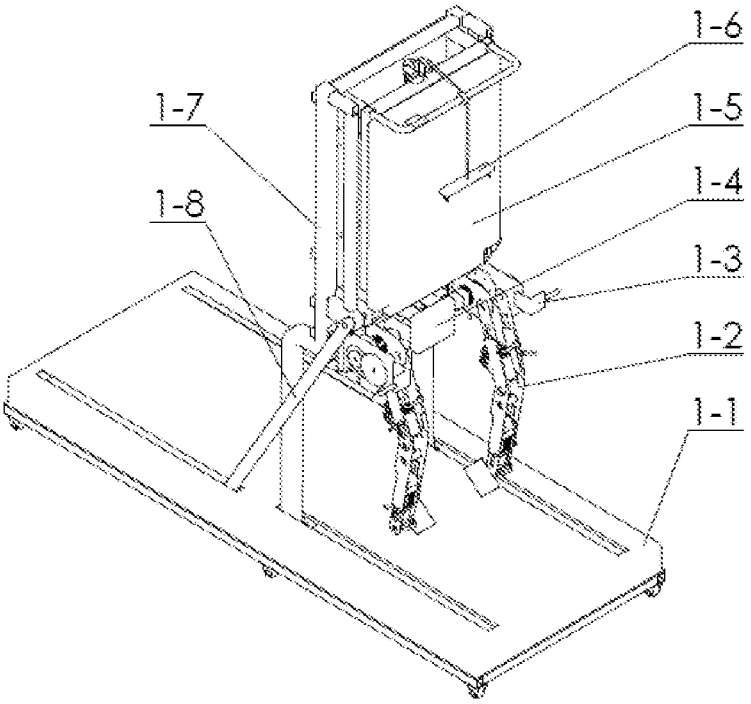
Fig.1.1
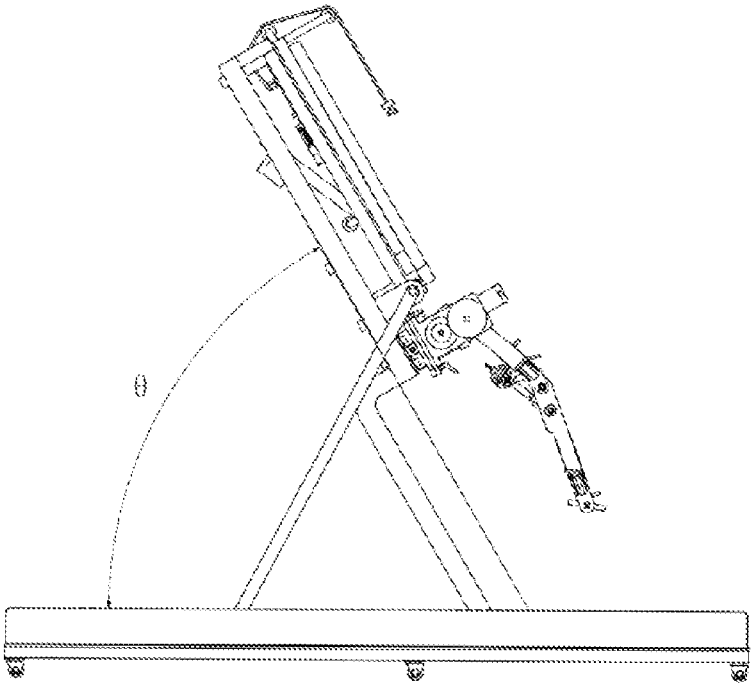
Fig.1.2

MULTI-POSTURE LOWER LIMB REHABILITATION ROBOT

TECHNICAL FIELD

The application relates to the technical field of medical devices, and particularly to a multi-posture lower limb rehabilitation robot.

TECHNICAL BACKGROUND

The number of lower limb paralyzed patients caused by stroke, spinal cord injury and traumatic brain injury is very large and shows an uptrend. After symptomatic treatment of acute stage, paraplegic patients often need longer-term rehabilitation to restore lower limb motor function. Therapeutic exercise is a common method for lower limb rehabilitation. The traditional rehabilitation method is that the patient's lower limbs are driven manually by therapist to do rehabilitation training. So, it is very subjective and time-consuming, and the effect is not satisfactory. As a kind of automated, accurate, intelligent medical equipment, rehabilitation robots have strong advantages in providing continuous, quantitative rehabilitation training, can effectively overcome the shortage of traditional rehabilitation methods and have broad application prospects. In clinical rehabilitation training, different postures and trajectories are often applied in different rehabilitation stages to get better recovery result. For patients in early rehabilitation stage, passive training of lying posture is often used to prevent muscle atrophy and to reduce complications. For patients in midterm rehabilitation stage, the training posture needs to translate from lying to standing to overcome the problem of orthostatic hypotension. During the later rehabilitation stage, patients usually have certain lower limb muscle strength, and hence, it is possible to consider passive or active gait training with the help of weight support system to overcome a part of body weight. It makes patients restore independent walking ability and back to activities of daily living as early as possible. At the same time, for the patients in the early and middle stage, bicycle training of the sitting posture is usually used in practice. This training method can be achieved by a relatively simple rehabilitation bicycle. The training cost is lower and the training preparation process is faster, and hence, the method can be applied to the high intensity and frequency rehabilitation training. Currently, rehabilitation bicycles are widely used in the rehabilitation therapy for patients with lower limb paralysis.

However, for most existing rehabilitation robot systems, the training trajectories are designed for a certain training posture. It is difficult to meet the paralyzed patient's training needs of different rehabilitation stages. Besides, it is difficult to design and optimize the rehabilitation prescription based on the same platform and standard to get the best recovery result.

SUMMARY

To address the above issues, the application presents a multi-posture lower limb rehabilitation robot. It can provide lying, sitting and standing posture training and gait training very similar to the human natural walking. Moreover, both active and passive modes are provided for the aforementioned training.

The application presents a multi-posture lower limb rehabilitation robot, which consists of two modules: robot base 1-1 and training bed.

The robot base 1-1 is a support base for the multi-posture lower limb rehabilitation robot. Wheels are installed on the bottom of the robot base for transferring the multi-posture lower limb rehabilitation robot. A bed adjustment mechanism is installed on the robot base, and hinged to the bed frame 1-7 through the bed support module 1-8, and can be used to adjust the bed angle to change the patient's posture during training.

The training bed comprises leg mechanisms 1-2, a seat 1-4, a seat width adjustment mechanism, a mechanism for adjusting gravity center of human body, a back cushion 1-5, a back cushion frame 5-1, a mechanism for adjusting the angle of seat back cushion, a bed frame 1-7 and a weight support system 1-6.

The leg mechanism 1-2 comprises the hip, knee and ankle joints, and the thigh and shank linkages, which can be used to fix patient's lower limbs and to help patient do lower limb rehabilitation training.

The seat 1-4 is used as a seat for patients and to support the weight of patient during the sitting training.

The seat 1-4 is installed fixedly on the seat width adjustment mechanism. The seat width adjustment mechanism is used to adjust the distance between the two leg mechanisms 1-2, to accommodate patients of different body size. The seat width adjustment mechanism is installed on the mechanism for adjusting gravity center of the patient's body, which is used to real-timely adjust the position of the patient's gravity center and to simulate the vertical variation of the gravity center of human body during natural walking. The seat arm 1-3 is installed on each side of the seat 1-4 to provide hand support for patient during the training.

The back cushion 1-5 is used to support the weight of the patient's upper body during the lying training. The back cushion is fixed on the front of the back cushion frame 5-1, one end of which is hinged to the bed frame 1-7.

The mechanism for adjusting back cushion angle is installed between the back cushion frame 5-1 and the bed frame 1-7. The mechanism for adjusting back cushion angle is used to adjust the angle of the back cushion for improving the patient's comfort during the sitting or lying training.

The weight support system 1-6 is driven by the motor 4-11 and installed on the back side of back cushion frame 5-1 to balance part or all of the patient's weight. (In the system, the side near patient is defined as front, and the side far away from patient is defined as back.)

The application has the following advantages:

(1) By designing the bed adjustment mechanism and the mechanism for adjusting back cushion angle, the lying, sitting and standing training can be implemented based on the same device.

(2) The lengths of the thigh and shank of leg mechanism 1-2, and the width of the seat can be adjusted to meet the training needs of patients having different body sizes.

(3) The body weight support system is driven by electric motor. The weight support force can be continuously adjusted according to the restoration of patient's lower strength, and hence, it can provide suitable power assistance during the rehabilitation training.

(4) The body weight support system, the mechanism for adjusting gravity center of human body and the leg mechanism 1-2 can be used together to simulate human natural gait.

(5) The training bed angle can be continuously adjusted to meet the patient's need of overcoming orthostatic hypotension, during the midterm rehabilitation.

(6) The back cushion angle can be continuously adjusted to meet the patient's need of implementing the lying or sitting training during early or midterm rehabilitation and to improve the patient's comfort during the training.

BRIEF DESCRIPTION OF DRAWINGS

FIG. 1.1 is an overall configuration diagram of the multi-posture lower limb rehabilitation robot according to an embodiment of the present application;

FIG. 1.2 is a bed angle diagram according to an embodiment of the present application;

Figure 2:
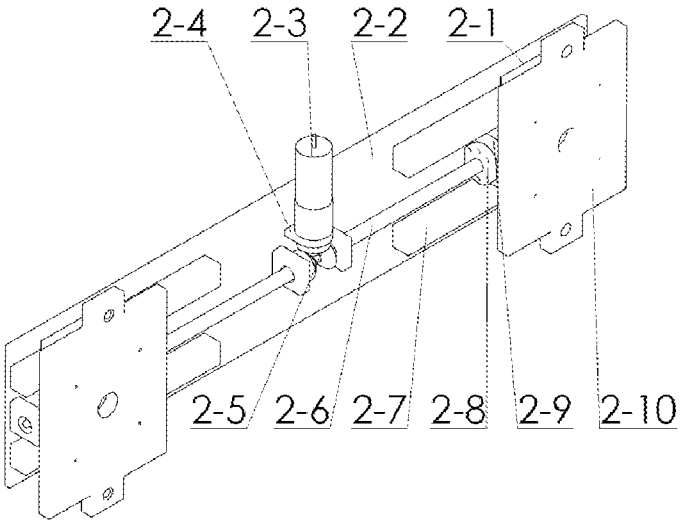
FIG. 2 is a configuration diagram of the seat width adjustment mechanism according to an embodiment of the present application.

In figures: 1-1 robot base; 1-2 leg mechanism; 1-3 arm; 1-4 seat; 1-5 back cushion; 1-6 weight support system; 1-7 bed frame; 1-8 bed support module; 2-1 rail saddle of the seat width adjustment mechanism; 2-2 mounting plate of the seat width adjustment mechanism; 2-3 driving motor of the seat width adjustment mechanism; 2-4 motor mounting plate of the seat width adjustment mechanism; 2-5 bevel gear train of the seat width adjustment mechanism; 2-6 lead screw of the seat width adjustment mechanism; 2-7 linear guide rail of the seat width adjustment mechanism; 2-8 screw nuts of the seat width adjustment mechanism; 2-9 screw nut mounting plate of the seat width adjustment mechanism; 2-10 mounting plate of the leg mechanism; 3-1 mounting plate of the mechanism for adjusting gravity center of human body; 3-2 driving motor of the mechanism for adjusting gravity center of human body; 3-3 motor mounting plate of the mechanism for adjusting gravity center of human body; 3-4 lead screw of the mechanism for adjusting gravity center of human body; 3-5 screw nut of the mechanism for adjusting gravity center of human body; 3-6 screw nut mounting plate of the mechanism for adjusting gravity center of human body; 3-7 linear guide rail of the mechanism for adjusting gravity center of human body; 3-8 rail saddle of the mechanism for adjusting gravity center of human body; 4-1 bandage hook; 4-2 hook beam; 4-3 weight support rope, 4-4 weight support gear train, 4-5 rail saddle of the weight support system, 4-6 screw nut of the weight support system; 4-7 screw nut mounting plate of the weight support system; 4-8 linear guide rail of the weight support system; 4-9 lead screw of the weight support system; 4-10 lead screw coupling of the weight support system; 4-11 driving motor of the weight support system; 4-12 mounting plate of the weight support system; 5-1 back cushion frame; 5-2 beam A of the mechanism for adjusting back cushion angle; 5-3 electric push rod of the mechanism for adjusting back cushion angle; 5-4 beam B of the mechanism for adjusting back cushion angle;

DETAILED DESCRIPTION

To make the purpose, technical solution and advantages clear, the application is described in details by embodiments and attached figures. FIG. 1.1 is an overall configuration diagram of the multi-posture lower limb rehabilitation robot according to an embodiment of the present application. The multi-posture lower limb rehabilitation robot mainly comprises a robot base 1-1 and a training bed. In order to simplify the description, we define the side near the patient of each component as front, and the side far away from the patient as back in this embodiment.

The position description of the components of the embodiment is according to the vertical relationship when the training bed is in the vertical state. The robot base 1-1 is the base of the multi-posture lower limb rehabilitation robot and used to support the training bed weight. Wheels are installed on bottom of the robot base 1-1 and used to facilitate the transfer of the lower limb rehabilitation robot. The robot base 1-1 comprises a set of bed angle adjustment mechanism. The bed angle adjustment mechanism is linked with the training bed through the bed support module 1-8 and the bed frame 1-7 can be used to adjust the angle between the training bed and the robot base 1-1, namely the angle θ in FIG. 1.2. When $\theta=0°$, the bed is in the horizontal state to provide the lying training. When $0°<\theta<90°$, the bed is in the inclined state to provide the rehabilitation training for overcoming orthostatic hypotension. When $\theta=90°$, the bed is in the vertical state to provide the standing rehabilitation training including the gait training, the stepping training, etc.

As shown in FIG. 1.1, there are two leg mechanisms 1-2 in the robot, both of which are robot arm with three degrees of freedom. In FIG. 1.1, the bed is in the vertical state and the joints of each leg mechanism 1-2 are the hip, knee and ankle, which are arranged in order from top to bottom. The two leg mechanisms are respectively on one side of the training bed. During training, the patient's legs are fixed on the leg mechanisms 1-2 respectively. The hip, knee and ankle of patients are corresponding respectively to those of the leg mechanisms 1-2. Patient's thigh and shank are corresponding to the thigh and shank of leg mechanisms. So, the leg mechanisms can drive the patient legs to implement motion training. At the same time, there are angle and force sensors mounted on the joints of each leg mechanism 1-2, which are used to recognize patient's intention for providing active and assisted training to the patient.

The FIG. 2 shows the seat width adjustment mechanism according to an embodiment of the present application. As shown in the FIG. 2, the seat width adjustment mechanism comprises four sets of rail saddles 2-1, a set of mounting plate 2-2, a driving motor 2-3, a set of motor mounting plate 2-4, a set of bevel gear train 2-5, two sets of lead screws 2-6, four sets of linear guide rails 2-7, two sets of screw nuts 2-8, two sets of screw nut mounting plates 2-9 and two sets of leg mechanism mounting plates 2-10. The driving motor 2-3 is fixedly installed on the motor mounting plate 2-4. The motor mounting plate 2-4 is fixed on the front of the mounting plate 2-2. The bevel gear train 2-5 comprises one input and two outputs. The input is fixedly connected with the output shaft of the driving motor 2-3 and the outputs are respectively fixedly connected with the associated lead screws 2-6. Each lead screw 2-6 and the corresponding screw nut 2-8 form a set of screw pair. Two screw nuts 2-8 are respectively fixedly installed on the corresponding screw nut mounting plates 2-9. Two screw nut mounting plates 2-9 are respectively fixed on the back of the associated leg mechanism mounting plates 2-10. The back of each leg mechanism mounting plates 2-10 are fixedly connected with two sets of rail saddles 2-1. Each rail saddle 2-1 and one corresponding linear guide rail 2-7 form a set of sliding pair. Each lead screw 2-6 is parallel with the two corresponding linear guide rails 2-7. On the front of each leg mechanism mounting plate 2-10, there is a corresponding set of leg mechanism 1-2.

When the driving motor 2-3 drives the lead screw 2-6 to rotate through the bevel gear train 2-5, the screw nut 2-8 will move along the lead screw 2-6 in straight line, and make the leg mechanism mounting plate 2-10 move along the linear guide rails 2-7 in straight line. Therefore, the distance of the two leg mechanisms 1-2 will be changed, and the seat width will be adjusted.

Figure 3:
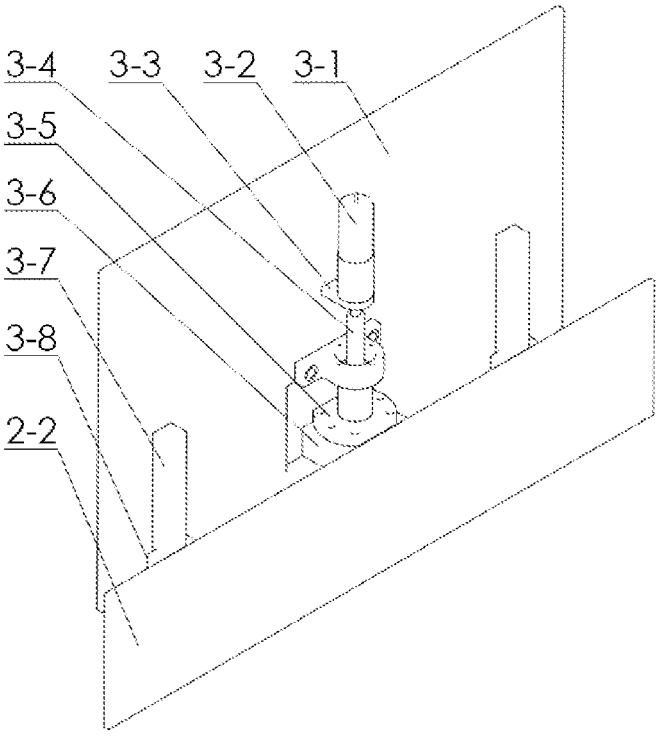
FIG. 3 is a configuration diagram of the mechanism for adjusting gravity center of human body according to an embodiment of the present application.

FIG. 3 is a configuration diagram of the mechanism for adjusting gravity center of human body according to an embodiment of the present application. As shown in FIG. 3, the mechanism for adjusting gravity center of human body comprises a set of mounting plate 3-1, a driving motor 3-2, a set of motor mounting plate 3-3, a set of lead screw 3-4, a set of screw nut 3-5, a set of screw nut mounting plate 3-6, a set of linear guide rail 3-7, and two sets of rail saddles 3-8. The back of mounting plate 3-1 is fixedly connected with the bed frame 1-7. The driving motor 3-2 is fixed on the motor mounting plate 3-3. The motor mounting plate 3-3 is fixed on the front of the mounting plate 3-1. The output shaft of the driving motor 3-2 is connected with the lead screw 3-4. The lead screw 3-4 and the screw nut 3-5 form a set of screw pair. The screw nut 3-5 is fixed on the screw nut mounting plate 3-6. The screw nut mounting plate 3-6 is fixed on the back of the mounting plate 2-2 of the seat width adjustment mechanism. The back of the mounting plate 2-2 is fixedly connected with the two sets of rail saddles 3-8. Each set of rail saddle 3-8 and one corresponding linear guide rail 3-7 form a slide pair. The two sets of linear guide rails 3-7 and the set of lead screw 3-4 are installed on the front of the mounting plate 3-1, and parallel to each other.

When the driving motor 3-2 drives the lead screw 3-4 to rotate, the mounting plate 2-2 will move along the linear guide rails 3-7 in straight line. The leg mechanism 1-2, the seat 1-4 and seat width adjustment mechanism are all installed on the mounting plate 2-2, and hence, the leg mechanism 1-2, the seat 1-4 and the seat width adjustment mechanism can be controlled to move along the linear guide rails 3-7 in straight line by the driving motor 3-2. (When the bed is in the upright state, the linear movement is vertical movement.) The mechanism for adjusting gravity center of human body can be used to control the patient's linear movement in vertical direction, which makes the patient's gravity center changed.

Figure 4:
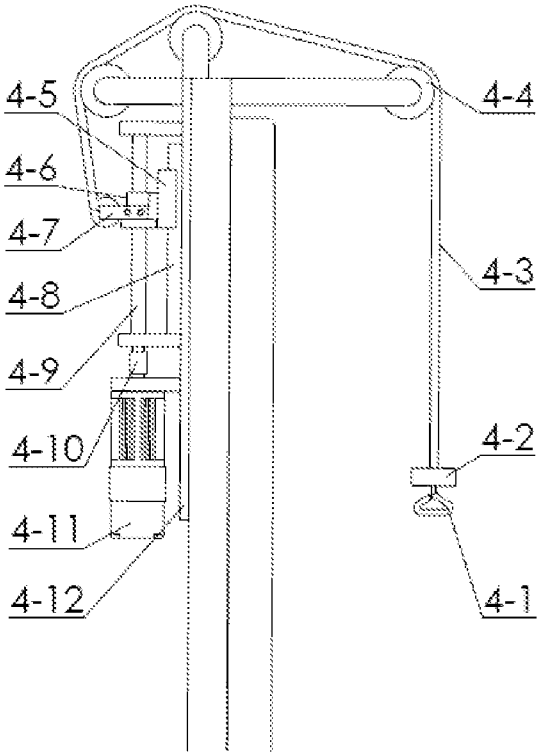
FIG. 4 is a configuration diagram of the body weight support system according to an embodiment of the present application.

FIG. 4 is a configuration diagram of the weight support system according to an embodiment of the present application. As shown in FIG. 4, the body weight support system comprises two sets of bandage hooks 4-1, a set of hook beam 4-2, a set of weight support rope 4-3, a set of weight support gear train 4-4, a set of rail saddle 4-5, a set of screw nut 4-6, a set of screw nut mounting plate 4-7, a set of linear guide rail 4-8, a set of lead screw 4-9, a set of lead screw coupling 4-10, a set of driving motor 4-11, and a set of mounting plate 4-12. The mounting plate 4-12 is fixed on the back of back cushion frame 5-1. The driving motor 4-11 is fixed on the mounting plate 4-12. The output of the driving motor 4-11 is connected with the lead screw 4-9 through the lead screw coupling 4-10. The lead screw 4-9 and the screw nut 4-6 form a set of rotation pair. The screw nut 4-6 is fixed on the screw nut mounting plate 4-7. The screw nut mounting plate 4-7 is fixedly connected with the rail saddle 4-5. The rail saddle 4-5 and the linear guide rail 4-8 form a set of slide pair. The screw nut mounting plate 4-7 is fixedly connected with one end of the rope 4-3. The motion direction of the rope 4-3 is changed through the gear train 4-4. The other end of the rope 4-3 is fixedly connected with the hook beam 4-2. Each end of the hook beam 4-2 is fixedly connected with a set of bandage hook 4-1, which is used to connect the bandage wearied by patients.

When the driving motor 4-11 drives the lead screw 4-9 to rotate, the screw nut 4-6 will move along the lead screw 4-9 in straight line, and one end of the rope 4-3 will move along the linear guide rail 4-8 in straight line. At the same time, the rope 4-3 will make the bandage hook 4-1 move linearly. As a result, the bandage is tightened or relaxed along the direction of patient's body. Thus, the weight support pulling force can be controlled through controlling the driving motor 4-11.

Figure 5:
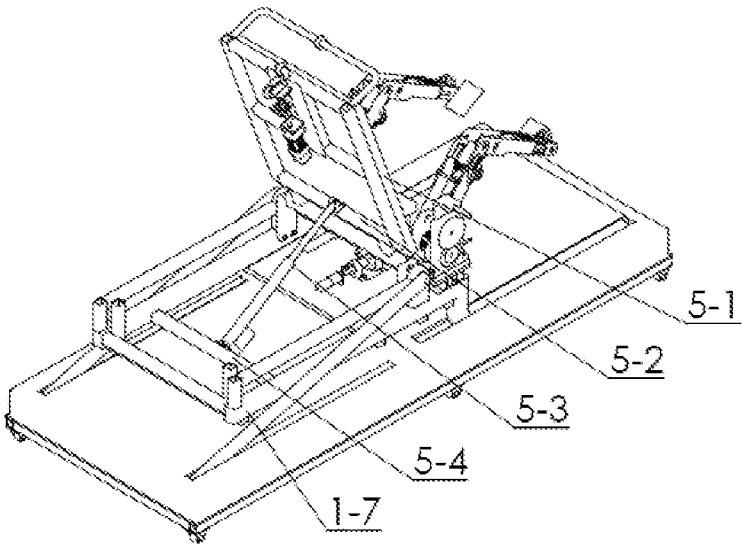
FIG. 5 is a configuration diagram of the mechanism for adjusting back cushion angle according to an embodiment of the present application.

FIG. 5 is a configuration diagram of the mechanism for adjusting back cushion angle according to an embodiment of the present application. As shown in FIG. 5, the mechanism for adjusting back cushion angle comprises a beam A 5-2, an electric push rod 5-3 and a beam B 5-4. In FIG. 5, the back cushion frame 5-1 is used to mount the back cushion 1-5. The beam A 5-2 is installed fixedly on the back cushion frame 5-1. The beam B 5-4 is installed fixedly on the bed frame 1-7. One end of electric push rod 5-3 is hinged with the beam A 5-2, and the other end is hinged with the beam B 5-4. The back cushion frame 5-1 is hinged with the bed frame 1-7.

The length of the electric push rod 5-3 is controlled by an electric motor. When the length of the electric push rod 5-3 is changed, the angle between the back cushion frame 5-1 and the bed frame 1-7 is changed, which is the inclination angle of the back cushion. Thus, the inclination angle of the back cushion can be controlled by adjusting the length of the electric push rod 5-3.

In this embodiment, the linear motion module of the seat width adjustment mechanism comprises a driving motor 2-3, a motor mounting plate 2-4, a bevel gear train 2-5, two lead screws 2-6, two screw nuts 2-8, two screw nut mounting plates 2-9. The linear motion module translates the rotation of the driving motor 2-3 to the linear motion of the screw nut 2-8 and makes the screw nut mounting plates 2-9 linearly move for the position adjustment. In practice, the linear motion module can be replaced by an electric push rod to accomplish the same function.

In this embodiment, the linear motion module of the mechanism for adjusting the gravity center of human body comprises a driving motor 3-2, a motor mounting plate 3-3, a lead screw 3-4, a screw nut 3-5 and a screw nut mounting plate 3-6. The linear motion module translates the rotation of the driving motor 3-2 to the linear motion of the screw nut 3-5 and makes the screw nut mounting plates 3-6 linearly move for the position adjustment. In practice, the linear motion module can be replaced by an electric push rod to accomplish the same function.

In this embodiment, the linear motion module of the weight support system comprises a driving motor 4-11, a lead screw coupling 4-10, a lead screw 4-9, a screw nut 4-6, a screw nut mounting plate 4-7. The linear motion module translates the rotation of the driving motor 4-11 to the linear motion of the screw nut 4-6 and makes the screw nut mounting plate 4-7 linearly move for the position adjustment. In practice, the linear motion module can be replaced by an electric push rod to accomplish the same function.

The above is only the detailed implementation of present application. However the protection scope of the present application is not limited by the implementation. Within the technical scope disclosed by the application, any transformation or replacement conceivable for persons skilled in the art should be covered in the protection scope of the application. Therefore, the protection scope of the present application is defined in the claims.

What is claimed is:

1. A multi-posture lower limb rehabilitation robot, characterized by that the robot comprises a robot base (1-1) and a training bed, wherein the robot base (1-1) is a support base for the multi-posture lower limb rehabilitation robot; a bed adjustment mechanism is installed on the robot base (1-1), and said bed adjustment mechanism is hinged to a bed frame (1-7) through a bed support module (1-8) and adapted to change a patient's training posture by adjusting an angle of the training bed;

wherein the training bed comprises two leg mechanisms (1-2), a seat (1-4), a seat width adjustment mechanism, a mechanism for adjusting a gravity center of human body, a back cushion (1-5), a back cushion frame (5-1), a mechanism for adjusting an angle of the back cushion, a bed frame (1-7) and a weight support system (1-6);

wherein each leg mechanism (1-2) comprises three joints: hip, knee and ankle joints, and two set of linkages: thigh and shank linkages; the leg mechanisms are used to fix a patient's lower limbs and to implement an assisted physical training for lower limbs;

wherein the seat (1-4) is used as a seat for a patient to support body weight during a sitting posture training; wherein the seat (1-4) is installed fixedly on the seat width adjustment mechanism; the seat width adjustment mechanism is used to adjust a distance between the two leg mechanisms (1-2) to accommodate sizes of patient's body; the seat width adjustment mechanism is installed on the mechanism for adjusting the gravity center of human body, which is used to adjust the gravity center of the patient's body in real time to simulate an up and down variation of the gravity center during natural walking;

wherein the back cushion (1-5) is used to support the weight of the patient's upper body in a lying posture training and is fixed on a front of the back cushion frame (5-1), one end of which is hinged with the bed frame (1-7);

wherein the mechanism for adjusting the angle of the back cushion is installed between the back cushion frame (5-1) and the bed frame (1-7); the mechanism for adjusting the angle of back cushion is used to adjust the angle of the back cushion for improving patient's comfort during the sitting or lying posture training; and wherein the weight support system (1-6) is driven by a first driving motor (4-11) and installed on a back of the back cushion frame (5-1) to balance part or all of the patient's weight;

wherein a seat arm (1-3) is installed on each side of the seat (1-4) to provide hand support during training, and wheels are installed on a bottom of the robot base (1-1) for transferring the multi-posture lower limb rehabilitation robot;

wherein the seat width adjustment mechanism comprises a first mounting plate (2-2) of the seat width adjustment mechanism, two leg mechanism bases (2-10) for installing the leg mechanisms, linear guide rails (2-7) left-and-right symmetrically designed for the seat width adjustment mechanism, rail saddles (2-1), which are used together with the linear guide rails (2-7), and linear motion module of the seat width adjustment mechanism, wherein the linear motion module of the seat width adjustment mechanism is installed on the first mounting plate (2-2);

wherein a front of each leg mechanism base (2-10) is connected with each of the two leg mechanisms (1-2), and a back of each leg mechanism base (2-10) is connected with the linear motion module and the rail saddles (2-1), and wherein the linear guide rails (2-7) are corresponding to the rail saddles (2-1) and installed on the first mounting plate (2-2);

wherein the mechanism for adjusting the gravity center of human body comprises a second mounting plate (3-1), a linear motion module, a rail saddle (3-8) and a linear guide rail (3-7), wherein the second mounting plate (3-1) of the mechanism for adjusting the gravity center of human body is installed on the bed frame (1-7);

wherein the linear motion module of the mechanism for adjusting the gravity center of human body is installed on the second mounting plate (3-1) of the mechanism for adjusting the gravity center of human body, and connected fixedly with the first mounting plate (2-2) of the seat width adjustment mechanism;

wherein the rail saddle (3-8) is installed on one side of the first mounting plate (2-2) of the seat width adjustment mechanism, said side facing the second mounting plate (3-1) of the mechanism for adjusting the gravity center of human body; and wherein the linear guide rail (3-7) of the mechanism for adjusting the gravity center of human body are corresponding to the rail saddle (3-8) and are installed on the second mounting plate (3-1) of the mechanism for adjusting the gravity center of human body;

wherein the weight support system (1-6) comprises a weight support system mounting plate (4-12), a weight support system linear motion module, a weight support system rail saddle (4-5), a weight support system linear guide rail (4-8), a weight support rope (4-3), a hook beam (4-2), a wheel train (4-4) and bandage hooks (4-1), wherein the weight support system mounting plate (4-12) is installed on the back cushion frame (5-1);

wherein the weight support system linear motion module is installed on the weight support system mounting plate (4-12);

wherein the weight support system rail saddle (4-5) is installed on the weight support system linear motion module;

wherein the weight support system linear guide rail (4-8) is corresponding to the weight support system rail saddle (4-5);

wherein one end of the weight support rope (4-3) is connected with the weight support system linear motion module, and the other end of the weight support rope is connected with the hook beam (4-2);

wherein the wheel train (4-4) is installed on an upper part of the back cushion frame and used together with the weight support rope (4-3); and wherein there are two bandage hooks (4-1), which are respectively fixed at the two ends of the hook beam (4-2);

wherein the mechanism for adjusting the angle of back cushion comprises a beam A (5-2), an electric push rod (5-3) and a beam B (5-4), wherein the beam A (5-2) is installed fixedly on the back cushion frame (5-1); the beam B (5-4) is installed fixedly on the bed frame (1-7); one end of the electric push rod (5-3) is hinged with the beam A (5-2), and the other end of the electric push rod (5-3) is hinged with the beam B (5-4).

2. The multi-posture lower limb rehabilitation robot as claimed in claim 1, characterized by that the linear motion module of the seat width adjustment mechanism comprises a second driving motor (2-3), a motor mounting plate (2-4), a bevel gear train (2-5), two lead screws (2-6), two screw nuts (2-8), two screw nut mounting plates (2-9), wherein the second driving motor (2-3) is installed fixedly on the motor mounting plate (2-4); the motor mounting plate (2-4) is fixed on the first mounting plate (2-2); the bevel gear train (2-5) comprises an input and two outputs, wherein the input is connected fixedly with an output axle of the second driving motor (2-3) and the outputs are respectively connected fixedly with the two lead screws (2-6); each lead screw (2-6) and one corresponding screw nut (2-8) form a set of screw pair; the two screw nuts (2-8) are respectively installed fixedly on the corresponding screw nut mounting plates (2-9); the two screw nut mounting plates (2-9) are respectively fixed to the corresponding leg mechanism bases (2-10) and on a side facing the first mounting plate (2-2) of the seat width adjustment mechanism.

3. The multi-posture lower limb rehabilitation robot as claimed in claim 1, characterized by that the linear motion module of the mechanism for adjusting the gravity center of human body comprises a third driving motor (3-2), a motor mounting plate (3-3), a lead screw (3-4), a screw nut (3-5) and a screw nut mounting plate (3-6), wherein the third driving motor (3-2) is installed fixedly on the motor mounting plate (3-3); the motor mounting plate (3-3) is fixed on the second mounting plate (3-1); the lead screw (3-4) is connected with an output shaft of the third driving motor (3-2); the lead screw (3-4) and the screw nut (3-5) form a set of screw pair; the screw nut (3-5) is fixed on the screw nut mounting plate (3-6); the screw nut mounting plate (3-6) is installed fixedly on the first mounting plate (2-2) and on the side facing the second mounting plate (3-1).

4. The multi-posture lower limb rehabilitation robot as claimed in claim 1, characterized by that the linear motion module of the weight support system comprises the first driving motor (4-11), a lead screw coupling (4-10), a lead screw (4-9), a screw nut (4-6), a screw nut mounting plate (4-7), wherein the first driving motor (4-11) is fixed on the weight support system mounting plate (4-12); an output shaft of the first driving motor (4-11) is connected fixedly with the lead screw (4-9) through the lead screw coupling (4-10); the lead screw (4-9) and the screw nut (4-6) form a set of screw pair; the screw nut (4-6) is installed fixedly on the screw nut mounting plate (4-7); the screw nut mounting plate (4-7) is connected fixedly with the rail saddle (4-5); the screw nut mounting plate (4-7) is connected fixedly with one end of the weight support rope (4-3).

5. The multi-posture lower limb rehabilitation robot as claimed in claim 1, characterized by that the linear motion module of the seat width adjustment mechanism is an electric push rod.

6. The multi-posture lower limb rehabilitation robot as claimed in claim 1, characterized by that the linear motion module of the mechanism for adjusting the gravity center of human body is an electric push rods.

7. The multi-posture lower limb rehabilitation robot as claimed in claim 1, characterized by that the weight support system linear motion module is an electric push rods.

* * * * *